US011502403B2

(12) United States Patent
Cheng et al.

(10) Patent No.: US 11,502,403 B2
(45) Date of Patent: Nov. 15, 2022

(54) ANTENNA DESIGN ON PRINTED CIRCUIT BOARD

(71) Applicant: Arcadyan Technology Corporation, Hsinchu (TW)

(72) Inventors: Shih-Chieh Cheng, Tainan (TW); Shin-Lung Kuo, Kaohsiung (TW)

(73) Assignee: Arcadyan Technology Corporation

( * ) Notice: Subject to any disclaimer, the term of this patent is extended or adjusted under 35 U.S.C. 154(b) by 0 days.

(21) Appl. No.: 17/319,967

(22) Filed: May 13, 2021

(65) Prior Publication Data

US 2021/0367332 A1 Nov. 25, 2021

(30) Foreign Application Priority Data

May 25, 2020 (TW) ..... 109117384

(51) Int. Cl.
*H01Q 1/52* (2006.01)
*H01Q 5/307* (2015.01)
*H01Q 1/38* (2006.01)

(52) U.S. Cl.
CPC ..... *H01Q 1/521* (2013.01); *H01Q 1/38* (2013.01); *H01Q 5/307* (2015.01)

(58) Field of Classification Search
CPC ..... H01Q 1/521; H01Q 1/38; H01Q 5/307; H01Q 5/40; H01Q 21/28; H01Q 1/36; H01Q 5/30
See application file for complete search history.

(56) References Cited

U.S. PATENT DOCUMENTS

| | | | | |
|---|---|---|---|---|
| 10,389,021 | B1 * | 8/2019 | Thakur | H01Q 1/521 |
| 2008/0136736 | A1 * | 6/2008 | Proctor | H01Q 5/50 343/893 |
| 2016/0156110 | A1 * | 6/2016 | Cohen | H01Q 21/24 343/810 |

FOREIGN PATENT DOCUMENTS

| | | | |
|---|---|---|---|
| TW | M426151 | U1 | 4/2012 |
| TW | 201937810 | A | 9/2019 |
| TW | I682583 | B | 1/2020 |

* cited by examiner

*Primary Examiner* — David E Lotter
(74) *Attorney, Agent, or Firm* — Innovation Counsel LLP

(57) ABSTRACT

The present invention discloses a printed circuit board (PCB). The printed circuit board includes a plurality of layers, a first antenna, a second antenna, a third antenna and an isolator. The first antenna is arranged on a first layer of the layers. The second antenna is arranged on the first layer. The isolator is arranged on the first layer and located between the first antenna and the second antenna. The third antenna is arranged on a second layer of the layers, wherein the second layer is different from the first layer. A position of the third antenna overlaps a position of the isolator in a direction perpendicular to a surface of the printed circuit board.

9 Claims, 2 Drawing Sheets

ANTENNA DESIGN ON PRINTED CIRCUIT BOARD

This application claims the benefit of Taiwan application Serial No. 109117384, filed May 25, 2020, the subject matter of which is incorporated herein by reference.

BACKGROUND OF THE INVENTION

Field of the Invention

The invention relates in general to an antenna design on printed circuit board (PCB).

Description of the Related Art

Since the functions of single electronic device are getting more and more diversified, the circuit complexity is also getting more and more complicated. Under the circumstances that the area of the printed circuit board is limited, the conventional single-layer and double-layer printed circuit boards can no longer meet the needs, and the multi-layer printed circuit board is gradually used widely. For an electronic device with communication function, such as router, antenna is an essential element. To enhance the reception ability or increase the reception bandwidth, normally the electronic device is equipped with a plurality of antennas. However, the antennas need to be isolated by isolator to avoid mutual interference being generated between the antennas which also occupy a large area. Therefore, if the number of antennas is increased without excellent design, the antennas will occupy a considerable size of area of the printed circuit board and will crowd out the configuration of other circuits.

SUMMARY OF THE INVENTION

According to one embodiment of the present invention, a printed circuit board (PCB) is disclosed. The printed circuit board includes a plurality of layers, a first antenna, a second antenna, a third antenna and an isolator. The first antenna is arranged on a first layer of the layers. The second antenna is arranged on the first layer. The isolator is arranged on the first layer and located between the first antenna and the second antenna. The third antenna is arranged on a second layer of the layers, wherein the second layer is different from the first layer. A position of the third antenna overlaps a position of the isolator in a direction perpendicular to a surface of the printed circuit board.

According to another embodiment of the present invention, a printed circuit board is disclosed. The printed circuit board includes a plurality of layers, a first antenna, a second antenna, a third antenna, a fourth antenna, a fifth antenna, a first isolator, a second isolator and a third isolator. The first antenna is arranged on a first layer of the layers. The second antenna is arranged on the first layer. The fourth antenna is arranged on the first layer. The first isolator is arranged on the first layer and located between the first antenna and the second antenna. The second isolator is arranged on the first layer and located between the second antenna and the fourth antenna. The third antenna is arranged on a second layer of the layers, wherein the second layer is different from the first layer. The fifth antenna is arranged on the second layer. The third isolator is arranged on the second layer and located between the third antenna and the fifth antenna. A position of the third antenna overlaps a position of the first isolator in a direction perpendicular to a surface of the printed circuit board. A position of the fifth antenna overlaps a position of the second isolator in a direction perpendicular to a surface of the printed circuit board. A position of the second antenna overlaps a position of the third isolator in a direction perpendicular to a surface of the printed circuit board.

The above and other aspects of the invention will become better understood with regard to the following detailed description of the preferred but non-limiting embodiment (s). The following description is made with reference to the accompanying drawings.

DETAILED DESCRIPTION OF THE INVENTION

Figure 1A:
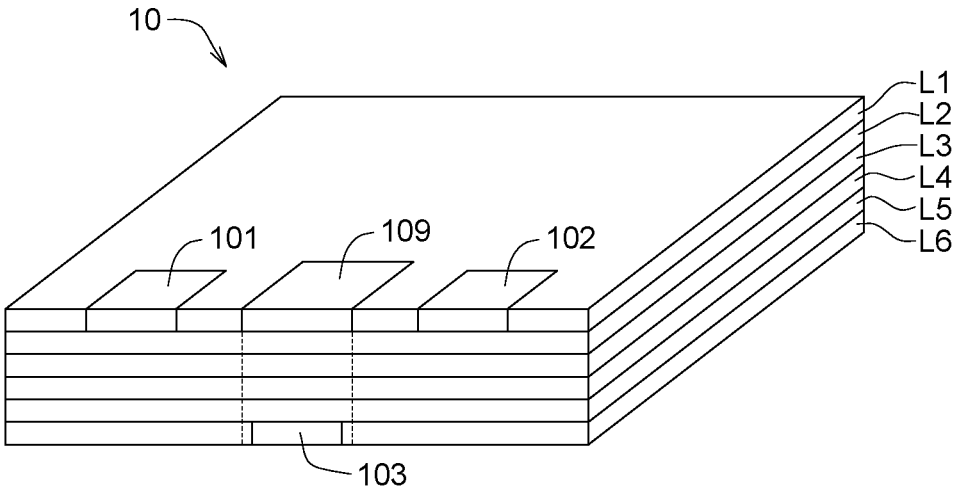
FIGS. 1A and 1B are schematic diagrams of a printed circuit board according to an embodiment of the present invention.

Referring to FIG. 1A, a schematic diagram of a printed circuit board according to an embodiment of the present invention is shown. The printed circuit board 10 includes a plurality of layers L1~L6, a first antenna 101, a second antenna 102, a third antenna 103 and an isolator 109. The printed circuit board 10 may further include other circuits. For simplicity, non-essential circuits are omitted in the drawing.

In the present embodiment, the printed circuit board 10 can be realized by a six-layer board, but the present invention is not limited thereto. For example, in other embodiments, the printed circuit board can have two or more than two layers. One or several of the layers L1~L6 are conductive layers, and the remaining layers are insulating layers.

The first antenna 101 and the second antenna 102 are arranged on a first layer, such as L1, of the printed circuit board 10. The isolator 109 is arranged on the first layer L1 of the printed circuit board 10 and is located between the first antenna 101 and the second antenna 102. In an embodiment, the first antenna 101 and the second antenna 102 are configured to transmit and receive wireless signals of a first band. The first band is such as 2 GHz. The isolator 109 is configured to isolate the first antenna 101 and the second antenna 102 and avoid mutual interference of signals between the first antenna 101 and the second antenna 102.

The third antenna 103 is arranged on a second layer, such as L6, of the printed circuit board 10, wherein the second layer L6 is different from the first layer. A position of the third antenna 103 overlaps the isolator 109 in a direction perpendicular to a surface of the printed circuit board 10. The third antenna 103 is configured to transmit and receive wireless signals of a second band. The second band is such as 5 GHz.

Despite that the first antenna 101, the second antenna 102 and the third antenna 103 are arranged on different layers, the isolator 109 still can isolate the first antenna 101, the second antenna 102 and the third antenna 103 and avoid mutual interference of signals through the design of a position of the third antenna 103 overlapping a position of the isolator 109 in a direction perpendicular to a surface of the printed circuit board.

In another embodiment, the first antenna 101 is configured to receive wireless signals of the first band, the second antenna 102 is configured to receive wireless signals of a third band, and the third antenna 103 is configured to receive wireless signals of the second band. That is, the first antenna 101 and the second antenna 102 can be configured to receive wireless signals of different bands.

In an alternate embodiment, the first antenna 101, the second antenna 102 and the third antenna 103 all are configured to receive wireless signals of the first band.

Figure 1B:
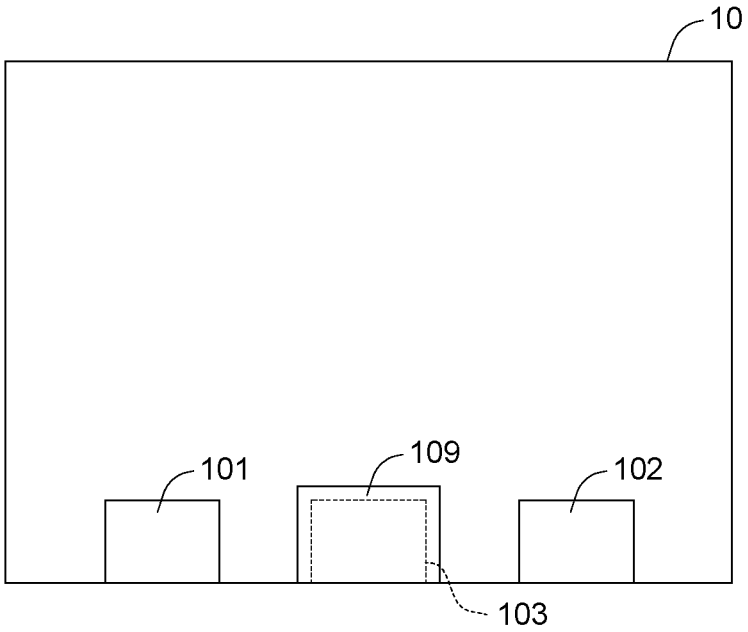

In an embodiment as indicated in FIG. 1B, the area of projection of the third antenna 103 in a direction perpendicular to the printed circuit board 10 is smaller than or equivalent to the area of projection of the isolator 109 in a direction perpendicular to the printed circuit board 10. In an embodiment, the area of projection of the third antenna 103 in a direction perpendicular to the printed circuit board 10 is fully covered within the area of projection of the isolator 109 in a direction perpendicular to the printed circuit board 10.

It should be noted that although the second layer is exemplified by L6 in the present embodiment, the present invention is not limited thereto. Besides, the present invention does not limit the number of layers of the printed circuit board 10. For example, the printed circuit board 1 can be an eight-layer board.

It should be noted that in actual situations, the antenna can have an irregular shape, such as L-shape or F-shape. In the present embodiment, the projection of each of the first antenna 101, the second antenna 102 and the third antenna 103 in a direction perpendicular to a surface of the printed circuit board can respectively be defined as the smallest rectangular area required to fully cover the first antenna, the second antenna and the third antenna in a direction perpendicular to the printed circuit board. The projection of the isolator 109 in a direction perpendicular to a surface of the printed circuit board surface can also be defined as the smallest rectangular area required to fully cover the projection of the isolator in a direction perpendicular to a surface of the printed circuit board. The above exemplifications are applicable to the following embodiments.

Figure 2A:
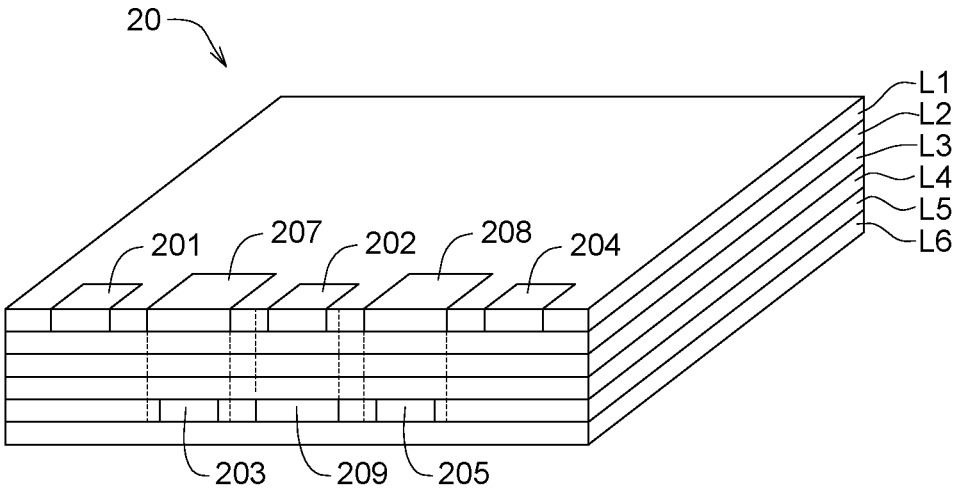
FIGS. 2A and 2B are schematic diagrams of a printed circuit board according to another embodiment of the present invention.

Refer to FIG. 2A, a schematic diagram of a printed circuit board according to another embodiment of the present invention is shown. The printed circuit board 20 includes a first antenna 201, a second antenna 202, a third antenna 203, a fourth antenna 204, a fifth antenna 205, a first isolator 207, a second isolator 208 and a third isolator 209.

The first antenna 201, the second antenna 202, the fourth antenna 204, the first isolator 207 and the second isolator 208 are arranged on a first layer, such as L1, of the printed circuit board 20. The first isolator 207 is located between the first antenna 201 and the second antenna 202. The second isolator 208 is located between the second antenna 202 and the fourth antenna 204. The third antenna 203, the fifth antenna 205 and the third isolator 209 are arranged on a second layer, such as L5, of the printed circuit board 20, wherein the second layer L5 is different from the first layer. The third isolator 209 is located between the third antenna 203 and the fifth antenna 205. The third antenna 203 overlaps the first isolator 207 in a direction perpendicular to the printed circuit board 20. The fifth antenna 205 overlaps the second isolator 208 in a direction perpendicular to the printed circuit board 20. The second antenna 202 overlaps the third isolator 209 in a direction perpendicular to the printed circuit board 20.

In an embodiment, the first antenna 201, the second antenna 202 and the fourth antenna 204 are configured to transmit and receive wireless signals of the first band; the third antenna 203 and the fifth antenna 205 are configured to transmit and receive wireless signals of the second band; the second band is different from the first band.

In another embodiment, the first antenna 201, the second antenna 202, the third antenna 203, the fourth antenna 204 and the fifth antenna 205 all are configured to transmit and receive wireless signals of the first band. In an alternate embodiment, the bands at which the first antenna 201, the second antenna 202, the third antenna 203, the fourth antenna 204 and the fifth antenna 205 transmit and receive wireless signals are not the same.

That is, the corresponding bands of the first antenna 201, the second antenna 202, the third antenna 203, the fourth antenna 204 and the fifth antenna 205 can be the identical, different or partly identical.

Figure 2B:
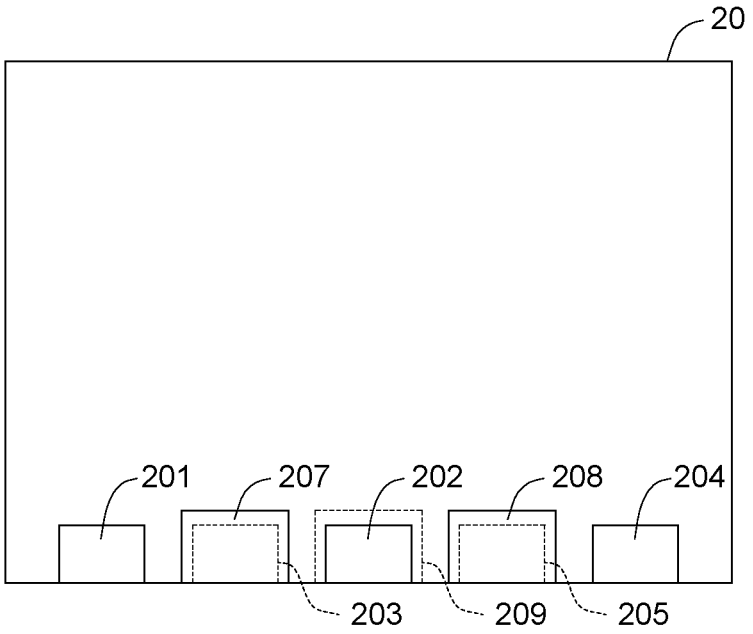

In an embodiment as indicated in FIG. 2B, the area of projection of the third antenna 203 in a direction perpendicular to the printed circuit board 20 is smaller than or equivalent to the area of projection of the first isolator 207 in a direction perpendicular to the printed circuit board 20. In an embodiment, the area of projection of the third antenna 203 in a direction perpendicular to the printed circuit board 20 is fully covered within the area of projection of the first isolator 207 in a direction perpendicular to the printed circuit board 20. In an embodiment, the area of projection of the fifth antenna 205 in a direction perpendicular to the printed circuit board 20 is smaller than or equivalent to the area of projection of the second isolator 208 in a direction perpendicular to the printed circuit board 20. In an embodiment, the area of projection of the fifth antenna 205 in a direction perpendicular to the printed circuit board 20 is fully covered within the area of projection of the second isolator 208 in a direction perpendicular to the printed circuit board 20. In an embodiment, the area of projection of the second antenna 202 in a direction perpendicular to the printed circuit board 20 is smaller than or equivalent to the area of projection of the third isolator 209 in a direction perpendicular to the printed circuit board 20. In an embodiment, the area of projection of the second antenna 202 in a direction perpendicular to the printed circuit board 20 is fully covered within the area of projection of the third isolator 209 in a direction perpendicular to the printed circuit board 20.

The structures of antennas and isolators as well as the distance between the antennas and the isolators can be designed according to the generally known arrangements of the present technology field and actual needs, and the present invention does not have specific restrictions.

Through the antenna design on printed circuit board of the present invention, the wires arranged on different layers of the printed circuit board can overlap the isolator in a direction perpendicular to a surface of the printed circuit board to achieve isolation effect and avoid mutual interference being generated between the antennas arranged on different layers. Thus, since the number of isolators is reduced, the required area for the antennas can be reduced, and the cost also can be reduced.

While the invention has been described by way of example and in terms of the preferred embodiment (s), it is to be understood that the invention is not limited thereto. On the contrary, it is intended to cover various modifications and similar arrangements and procedures and the scope of the appended claims therefore should be accorded the broadest interpretation so as to encompass all such modifications and similar arrangements and procedures.

What is claimed is:

1. A printed circuit board (PCB), comprising:

a plurality of layers;

a first antenna arranged on a first layer of the plurality of layers;

a second antenna arranged on the first layer;

an isolator arranged on the first layer and located between the first antenna and the second antenna; and a third antenna arranged on a second layer of the plurality of layers, wherein the second layer is different from the first layer, wherein a position of the third antenna overlaps a position of the isolator in a direction perpendicular to a surface of the printed circuit board, wherein an area of projection of the third antenna in a direction perpendicular to the surface of the printed circuit board is smaller than or equivalent to an area of projection of the isolator in a direction perpendicular to the surface of the printed circuit board.

2. The printed circuit board according to claim 1, wherein the projection of the third antenna in a direction perpendicular to the surface of the printed circuit board is fully covered within the projection of the isolator in a direction perpendicular to the surface of the printed circuit board.

3. The printed circuit board according to claim 1, wherein the first antenna and the second antenna is configured to transmit and receive wireless signals of a first band and the third antenna is configured to transmit and receive wireless signals of a second band, and the second band is different from the first band.

4. The printed circuit board according to claim 1, wherein the first antenna is configured to transmit and receive wireless signals of a first band, the second antenna is configured to transmit and receive wireless signals of a second band, the third antenna is configured to receive wireless signals of a third band and the first band, and the second band and the third band are not the same.

5. A printed circuit board, comprising:

a plurality of layers;

a first antenna arranged on a first layer of the plurality of layers;

a second antenna arranged on the first layer;

a fourth antenna arranged on the first layer;

a first isolator arranged on the first layer and located between the first antenna and the second antenna;

a second isolator arranged on the first layer and located between the second antenna and the fourth antenna;

a third antenna arranged on a second layer of the plurality of layers, wherein the second layer is different from the first layer;

a fifth antenna arranged on the second layer; and a third isolator arranged on the second layer and located between the third antenna and the fifth antenna;

wherein a position of the third antenna overlaps a position of the first isolator in a direction perpendicular to a surface of the printed circuit board, a position of the fifth antenna overlaps a position of the second isolator in a direction perpendicular to a surface of the printed circuit board, a position of the second antenna overlaps a position of the third isolator in a direction perpendicular to a surface of the printed circuit board.

6. The printed circuit board according to claim 5, wherein an area of projection of the second antenna in a direction perpendicular to the surface of the printed circuit board is smaller than or equivalent to an area of projection of the third isolator in a direction perpendicular to the surface of the printed circuit board.

7. The printed circuit board according to claim 5, wherein the projection of the second antenna in a direction perpendicular to the surface of the printed circuit board is fully covered within the projection of the third isolator in a direction perpendicular to the surface of the printed circuit board.

8. The printed circuit board according to claim 5, wherein the first antenna, the second antenna and the fourth antenna are configured to transmit and receive wireless signals of a first band and the third antenna and the fifth antenna is configured to transmit and receive wireless signals of a second band, and the second band is different from the first band.

9. The printed circuit board according to claim 5, wherein the first antenna, the second antenna, the third antenna, the fourth antenna and the fifth antenna are configured to transmit and receive wireless signals od different bands.

* * * * *